United States Patent [19]

Mast

[11] 3,964,720

[45] June 22, 1976

[54] APPARATUS FOR FEEDING MATERIALS INTO A HAMMERMILL OR THE LIKE

[75] Inventor: Aquila D. Mast, Lancaster, Pa.

[73] Assignee: Sperry Rand Corporation, New Holland, Pa.

[22] Filed: Apr. 17, 1975

[21] Appl. No.: 569,021

[52] U.S. Cl. ..... 241/186 A; 241/101 A; 241/101.6

[51] Int. Cl.[2] ..... B02C 13/286

[58] Field of Search ..... 241/73, 101 A, 101.6, 241/101.7, 186 R, 186 A; 254/146, 186 HC

[56] References Cited

UNITED STATES PATENTS

| | | | |
|---|---|---|---|
| 1,006,596 | 10/1911 | Rose | 241/73 X |
| 1,701,221 | 2/1929 | Bartlett | 254/186 HC |
| 2,298,482 | 10/1942 | Holland-Letz | 241/101.6 |
| 2,711,964 | 6/1955 | Wiemer | 241/101.6 |
| 3,176,926 | 4/1965 | Hobbs, Jr. | 241/101.6 |
| 3,208,491 | 9/1965 | Bliss | 241/186 |
| 3,272,478 | 9/1966 | Binns | 254/186 HC |
| 3,741,487 | 6/1973 | Kanengieter | 241/101.7 |
| 3,771,733 | 11/1973 | Hadley et al. | 241/73 |
| 3,795,369 | 3/1974 | Moser | 241/73 |

*Primary Examiner*—Granville Y. Custer, Jr.
*Attorney, Agent, or Firm*—John R. Flanagan; Frank A. Seemar; Joseph A. Brown

[57] ABSTRACT

Apparatus for feeding materials, such as baled roughages, grains, ear corn and other feed materials, through an opening defined in the housing of a hammermill or similar material reducing mechanisms includes an elongated trough pivotally mounted at one end across a lower side of the housing opening, a pair of augers rotatably mounted in the trough and operable to convey feed materials along the trough and through the housing opening, a closure body disposed adjacent the housing opening and above the one end of the trough which normally substantially closes the housing opening but is pivotally movable to open a sufficient portion thereof for allowing passage of feed material, such as baled roughages, through the housing opening, and an adjustment assembly for disposing the trough and closure body with respect to the housing at various pivotally displaced feeding positions and a storage position.

16 Claims, 10 Drawing Figures

-260-
126
130
128
246
238
248
214
218
212
232
104
216
210
244
242
240
140
138
134
136
254
120
132
152
124
132
118
166
144
122
150
122
142
-106-
104
114
112
148
30
146
156
154
158
178
220
96
90
222
164
88
86
162
190
194
206
160
78
80
76
80
182
92
94
84
176
32
192
186
180
228
226
202
198
200

124
166
104
34
32
30

Fig. 5.
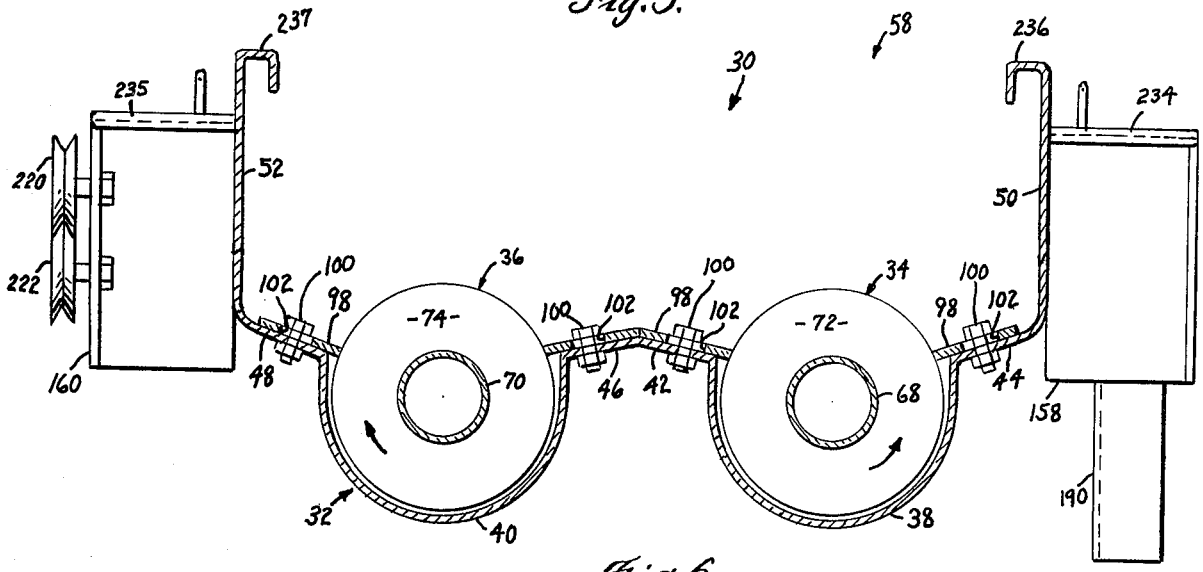
Fig. 6.
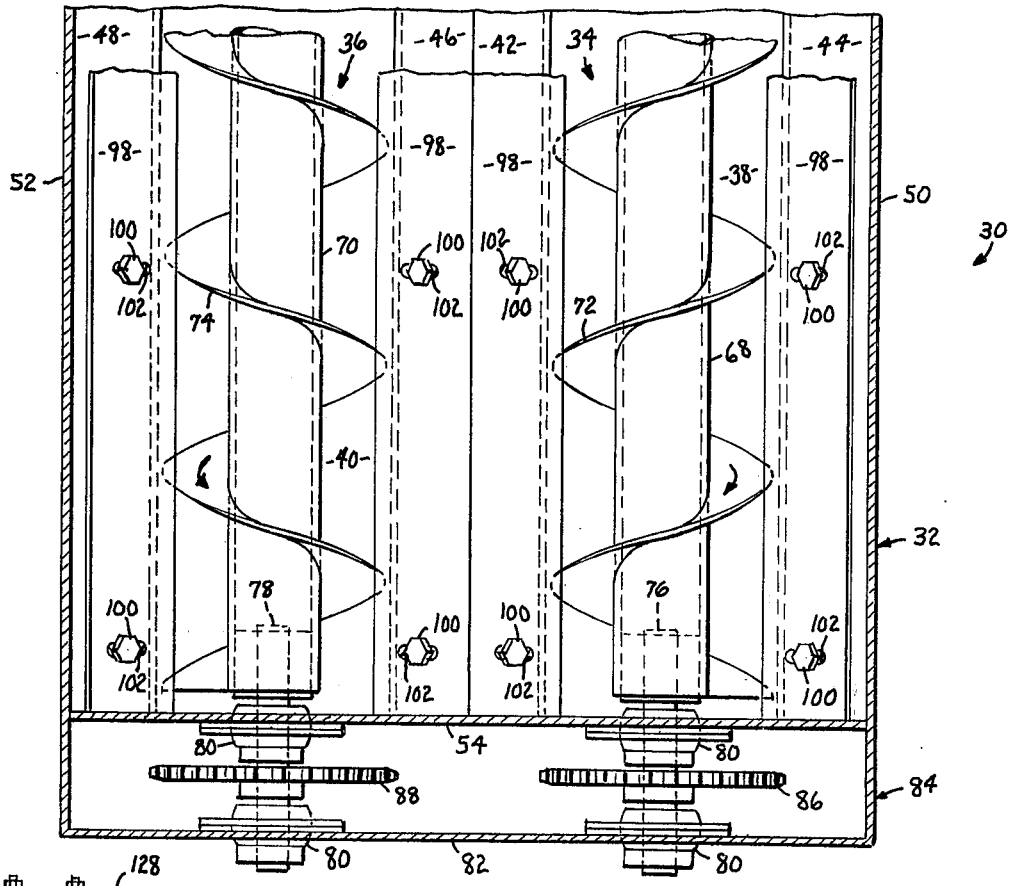
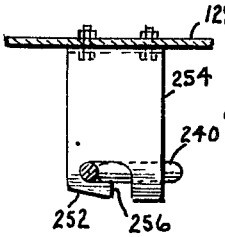
Fig. 7.

APPARATUS FOR FEEDING MATERIALS INTO A HAMMERMILL OR THE LIKE

BACKGROUND OF THE INVENTION

1. FIELD OF THE INVENTION

The present invention relates generally to material feeding apparatus and, more particularly, is concerned with apparatus for feeding baled roughages, ear corn, small grains and other feed materials into a hammermill or similar material reducing mechanisms.

2. DESCRIPTION OF THE PRIOR ART

Many conventional hammermills and other similar material reducing mechanisms are capable of grinding feed materials which vary widely in bulkiness and other characteristics, for instance, such feed materials as baled roughages, ear corn and small grains. Several different feeding arrangements have been devised to feed some or all of such diverse kinds of feed material into the hammermill. U.S. Pat. Nos. 3,039,505, 3,062,461 and 3,771,733 represent some of the prior art feeding arrangements.

A prior art feeding arrangement which I designed and developed for feeding all of such diverse kinds of feed materials into a hammermill included an elongated trough rigidly affixed at one end to the housing of the hammermill across a lower portion of an opening defined in the housing and a pair of augers mounted within the trough to counterrotate with respect to each other for feeding such materials along the trough and through the housing opening. Also, a metal door was mounted across the trough adjacent the housing opening to normally extend generally vertically and close the housing opening above the pair of augers and thereby prevent expulsion of material from the hammermill. Further, the door could be pivotally pushed rearwardly and upwardly by a roughage bale when the same engaged the front side of the door as it was being fed along the trough, such rearward and upward pivoting of the door allowing passage of the bale thereunder and through the housing opening. The door was generally similar in structure and function to that shown in my aforementioned U.S. Pat. No. 3,039,505.

One disadvantage of my prior art arrangement resided in the pivotal door utilized for closing the hammermill housing opening. Some of the material being ground or reduced by the hammermill rotor is propelled therefrom against the rear side of the door and became compressed and adhered thereon an/or on the upper interior portion of the housing or trough adjacent to where the door is mounted each time a bale pushed the door upwardly toward such upper interior housing or trough portion. Eventually, enough material accumulated in such areas to prevent the door from pivoting upwardly sufficiently to allow passage of subsequent bales.

Another disadvantage of my prior art feeding arrangement resided in the rigid mounting relationship of the trough to the hammermill housing. Such mounting relationship restricted the trough to one feeding position with respect to the hammermill housing and also restricted the maneuverability of the machine to which the hammermill was mounted.

SUMMARY OF THE INVENTION

The feeding apparatus of the present invention overcomes the aforementioned disadvantages of my previous feeding arrangement by obviating the possibility of ground material accumulating so as to impede the feeding of bales into the hammermill and by providing a plurality of possible feeding positions and a storage which enhances the overall utility and maneuverability of a grinder-mixer machine in which the hammermill is incorporated as a part thereof.

Accordingly, the feeding apparatus of the present invention broadly comprises elongated feeding means for receiving feed materials at an upper side thereof and being mounted at one end portion to the housing of a hammermill or the like adjacent a lower side of a material receiving opening therein and operable to convey feed materials into the housing through the opening, and closure means disposed adjacent the housing opening and adjacent and above the one end portion of the elongated feeding means. The closure means includes a first surface portion which extends along a path near the housing opening to normally substantially close the same. The closure means is movable upwardly away from the elongated feeding means upon being engaged by feed materials, such as baled roughages, as the latter is fed by the feeding means toward the housing opening. Such upward movement of the closure means causes its first surface portion to move upwardly along the aforesaid path relative to the housing opening and thererby open a sufficient portion of the housing opening for allowing passage of the feed material into the housing through the aforesaid portion of the housing opening.

More particularly, the closure means is pivotally movable upwardly away from the elongated feeding means and its first surface portion has a curved shape which defines the aforesaid path along which the first surface portion moves relative to the housing opening upon pivoting of the closure means. Also, the closure means includes a second surface portion angularly displaced from its first surface portion and normally disposed adjacent the one end portion of the feeding means across a path along which feed material, such as baled roughages, are moved by the feeding means. The closure means pivotally moves upwardly away from the feeding means upon being engaged at its second surface portion by such feed material as the same is fed by the feeding means toward the housing opening.

Further, the elongated feeding means includes an elongated trough having an open top side and an open end in communication with the housing opening, and operable conveying means in the form of a pair of augers extending longitudinally, and rotatably mounted, within the trough. Preferably, also, operative feed assist means is mounted in the housing at a location spaced above the one end portion of the elongated feeding means and adjacent an upper portion of the housing opening. The feed assist means engages upper portions of feed material, such as baled roughage, to thereby assist the feeding thereof through the housing opening by the elongated feeding means.

Still further, support means is mounted at one end to the housing and extends outwardly therefrom to an opposite end spaced above the elongated feeding means. The closure means is mounted to the opposite end of the support means for pivotal movement upwardly in relation thereto and away from the feeding means upon being engaged by feed material, such as baled roughage. Also, the feeding means is pivotally mounted at its one end to the housing and adjustment means is provided for concurrently disposing the feeding means together with the support means and the closure means mounted thereto at various pivotally displaced feeding positions with respect to the housing. The adjustment means is further capable of disposing the feeding means together with the support means and closure means mounted thereto at a generally upright storage position with respect to the housing. Releasable means is provided for locking the feeding means in its storage position.

Still more particularly, the adjustment means comprises support structure mounted to an upper side of the housing, winch device operatively associated with either the feeding means or the support structure, and a flexible member interconnecting the feeding means and the support structure and having a portion connected to the winch device. The winch device includes a drum rotatably supported by either the feeding means or the support structure and connected with the aforesaid portion of the flexible member, first means in the form of a crank arm secured to the drum and operable for rotating the drum to respectively wind the flexible member about the drum or unwind the flexible member therefrom, and second means operatively associated with at least either the crank arm or drum for maintaining the drum at any desired rotational position, after a desired amount of the flexible member has been wound thereabut or unwound therefrom, to thereby dispose the feeding means at any one of its various pivotally displaced feeding positions. The second means comprises a circular disc fixedly supported by either the feeding means or the support structure adjacent the crank arm, and a spring loaded pawl carried by the crank arm and adapted for biting contact with the periphery of the disc to lock the arm and thereby the drum to which the arm is secured at any desired rotational position.

Other advantages and attainments of the present invention will become apparent to those skilled in the art upon a reading of the following detailed description when taken in conjunction with the drawings in which there is shown and described a preferred or illustrative embodiment of the invention.

BRIEF DESCRIPTION OF THE DRAWINGS

In the course of the following detailed description reference will be frequently made to the attached drawings in which:

FIG. 5 is a front sectional view, on a somewhat enlarged scale, taken along line 5—5 of FIG. 2;

FIG. 6 is a plan sectional view taken along line 6—6 of FIG. 2;

FIG. 7 is a plan sectional view taken along line 7—7 of FIG. 1, illustrating a locking means of the apparatus;

DETAILED DESCRIPTION OF THE PREFERRED EMBODIMENT

In the following description, right hand and left hand references are determined by standing at the left side of FIG. 1 and facing toward the right side thereof, which is toward the front of the feeding apparatus. Also, in the following description, it is to be understood that such terms as "forward," "left," "upwardly," etc., are words of convenience and are not to be construed as limiting terms.

IN GENERAL

Figure 1:
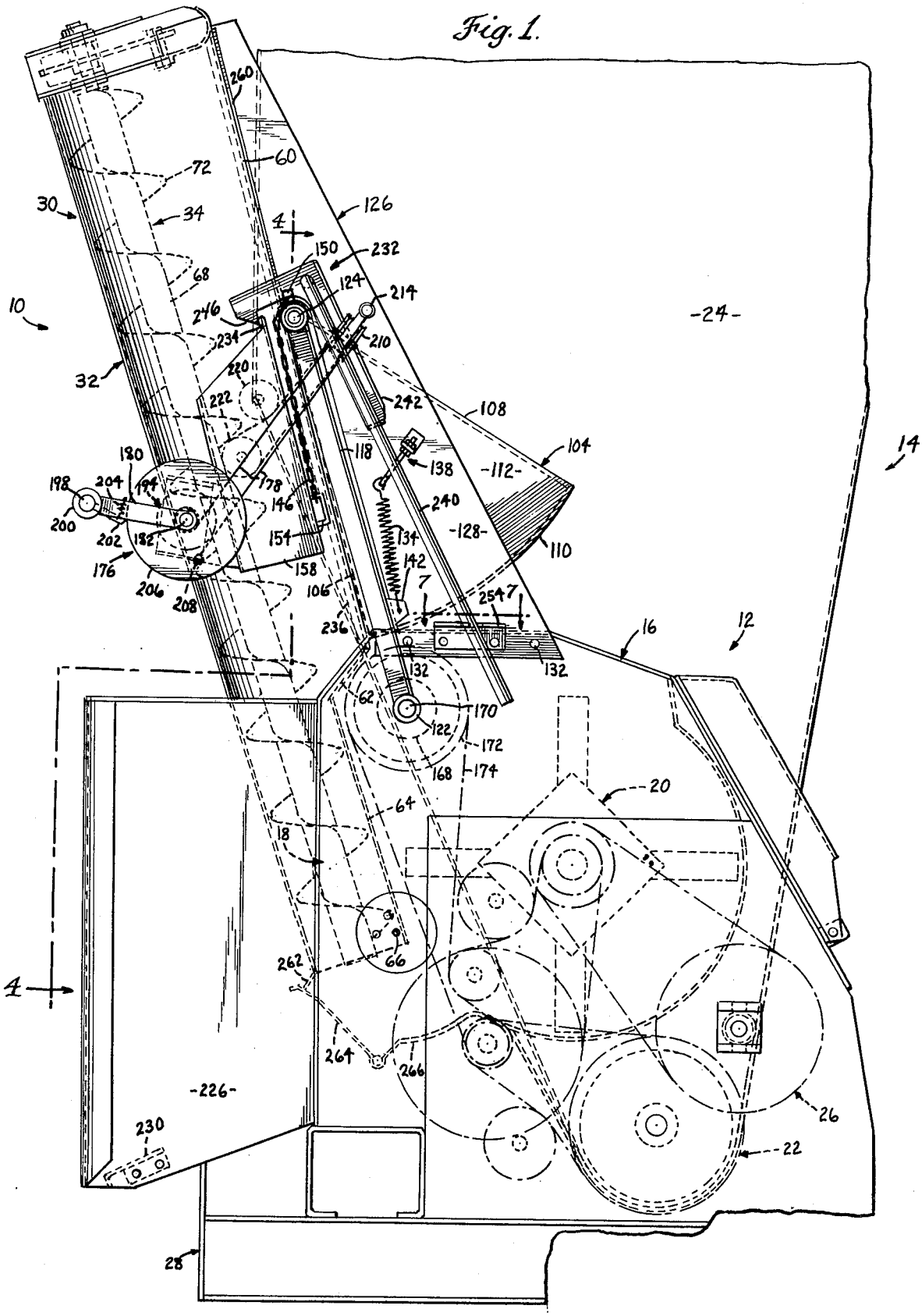
FIG. 1 is a side elevational view of the preferred embodiment of feeding apparatus constructed in accordance with the principles of the present invention, showing the apparatus associated with the hammermill of a grinder mixer machine and disposed in its generally upright storage or transport position.

Referring now to the drawings, and particularly to FIG. 1, there is shown the preferred embodiment of apparatus for feeding baled roughages, ear corn, grains and other feed materials, the feeding apparatus indicated generally by numeral 10. The feeding apparatus 10 is particularly suitable for feeding such feed materials into a hammermill 12 of a grinder-mixer machine 14, although it may be utilized in combination with other material reducing mechanisms.

The grinder-mixer 14 and the hammermill 12 operatively associated therewith are of well known construction and, therefore, suffice it to mention that the hammermill includes a housing 16 having a material receiving opening, generally indicated by 18, a material reducing rotor 20 rotatably mounted in the housing 16 and an auger 22 for transferring reduced feed material from the hammermill 12 to a mixing tank 24 of the grinder-mixer 12. Also, suitable means of a conventional type, generally indicated by numeral 26, is provided for driving the various operating components of the grinder-mixer 12 and hammermill 14 and may be powered by the power takeoff of a tractor. The grinder-mixer machine 14 includes a chassis or frame 28 which supports the hammermill housing 12 and the mixing tank 24 and is made mobile by a pair of wheels (not shown) mounted at one end thereof and suitable draft structure (not shown) extending from an opposite end of the frame 28 which adapts the machine 14 to be attached to and towed behind the tractor.

ELONGATED FEEDING MEANS

Referring now to FIGS. 1 through 3, 5 and 6, the apparatus 10 comprising the present invention includes elongated feeding means, generally designated by number 30, being adapted to receive a wide variety of feed materials, such as baled roughages, ear corn, small grains, etc., at an upper side thereof and operable to convey the same into the hammermill housing 16 through the material receiving opening 18 defined therein and to the hammermill rotor 20.

The elongated feeding means 30 includes an elongated trough 32 and a pair of side-by-side parallel augers 34,36 extending longitudinally and being rotatably mounted within the trough 32.

As more clearly seen in FIGS. 5 and 6, the trough 32 has a closed bottom formed by a pair of longitudinally-extending, spaced apart pocket portions 38,40 being semi-circular in cross-section and having longitudinally-extending flanges 42,44 and 46,48 respectively connected to inside and outside, opposite top longitudinal edges of the pocket portions 38,40. Each of the flanges also extends outwardly and slightly inclined upwardly from its corresponding pocket portion edge, with the adjacent inner flanges 42 and 46 being connected together. The trough 32 further has a pair of opposite, longitudinally-extending side walls 50,52, which each extend upwardly from, and is connected to, one of the outer flanges 44,48, and an end wall 54 which extends transversely to, and is connected to the outer ends of, the bottom and the side walls 50,52 of the trough 32 to thereby close the outer end thereof. The trough 32 is open at its inner end at 56 (FIG. 1) and the side walls 50,52 and end wall 54 thereof define an open top 58 (FIG. 5) through which the feed materials are received and which communicates with the open inner end 56.

Referring again to FIGS. 1 and 2, the trough side walls 50,52 each include an outer portion 60 having a height which decreases very gradually for approximately two-thirds of the length of the side wall from its outermost end. Then, for the remaining approximately one-third of its length, each of the side walls 50,52 includes, first, an intermediate portion 62 having a sharply decreasing height and, then, an inner portion 64 which extends to the inner end 56 of the trough 32 and has a generally uniform height which is substantially less than the average height of the outer portion 60 of the side wall. The purpose for the above-described height, and resulting upper profile, variations between the outer, intermediate and inner portions 60,62,64 of each of the side walls 50,52 will be explained in connection with the description of other elements of the feeding apparatus 10 hereinafter.

Near the inner ends of inner side wall portions 64, the trough 32 is pivotally mounted at 66 to each of the opposite sides of the hammermill housing 16 (only the right side thereof being seen in FIGS. 1 and 2) and, preferably, across a lower portion of the material receiving opening 18 defined therein.

Figure 2:
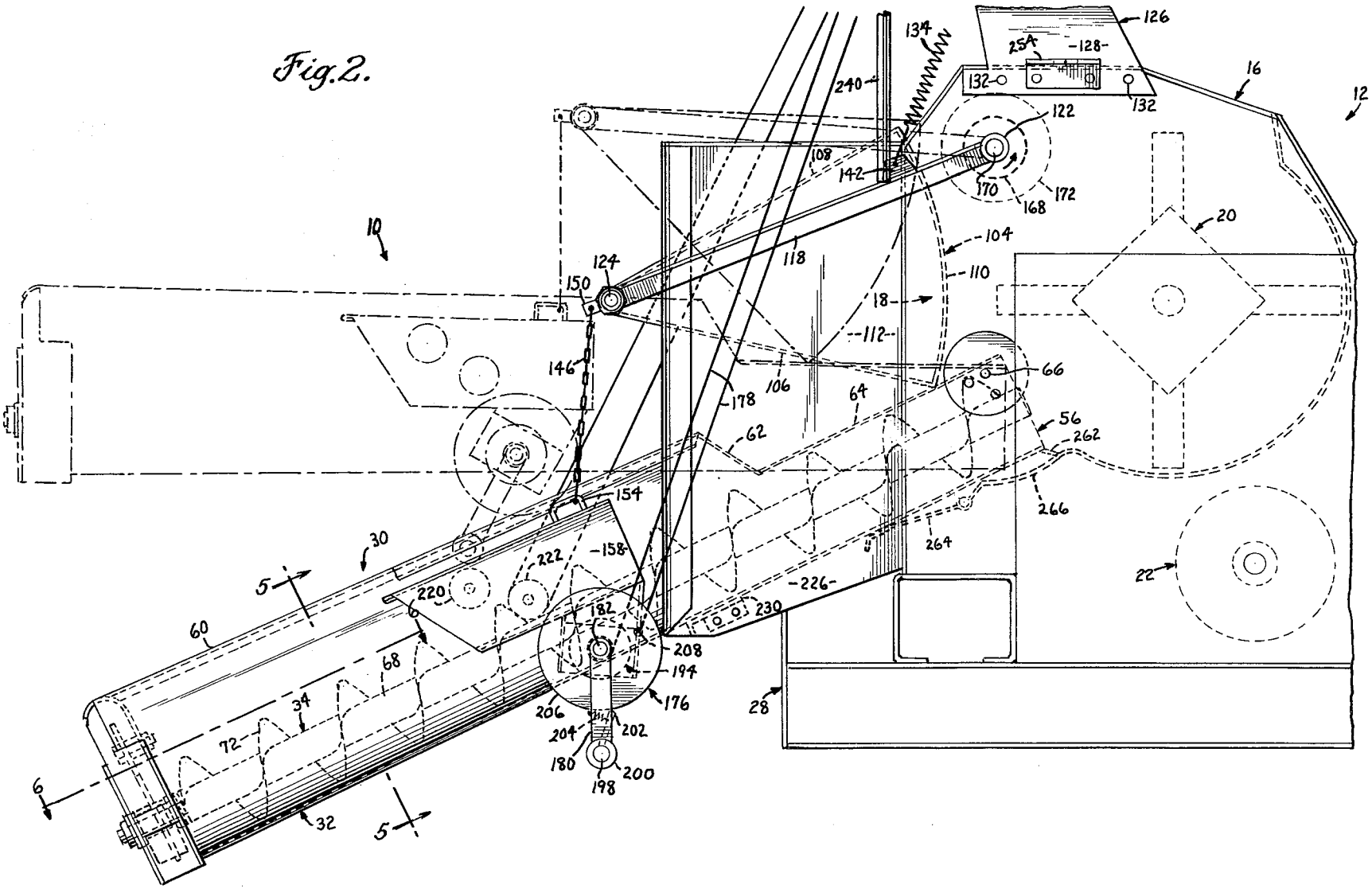
FIG. 2 is another side elevational view similar to that of FIG. 1, but showing the apparatus in an inclined material feeding position being illustrated in solid line form and in a generally horizontal position being illustrated in broken line form.

As mentioned hereinbefore, the elongated feeding means 30 includes a pair of parallel augers, 34,35. As clearly seen in FIGS. 3, 5 and 6, right auger 34 longitudinally extends along right pocket portions 38 of trough 32, while left auger 36 longitudinally extends along left pocket portion 40. The augers 34,36 respectively comprise central tubular shafts 68,70 which respectively mount flights 72,74 so as to spiral about the respective shafts 68,70 in opposing clockwise and counterclockwise directions, when viewed in FIG. 6, beginning at the outer ends of the shafts 68,70. The outer ends of shafts 68,70 are respectively secured to stub shafts 76,78 being rotatably mounted by bearings 80 to, and extending between and beyond, trough outer end wall 54 and an outer wall 82 of a drive housing 84 fixed to the outer end of the trough 32. The inner ends of auger shafts 68,70 are free, as seen in FIGS. 1 and 2.

Figure 3:
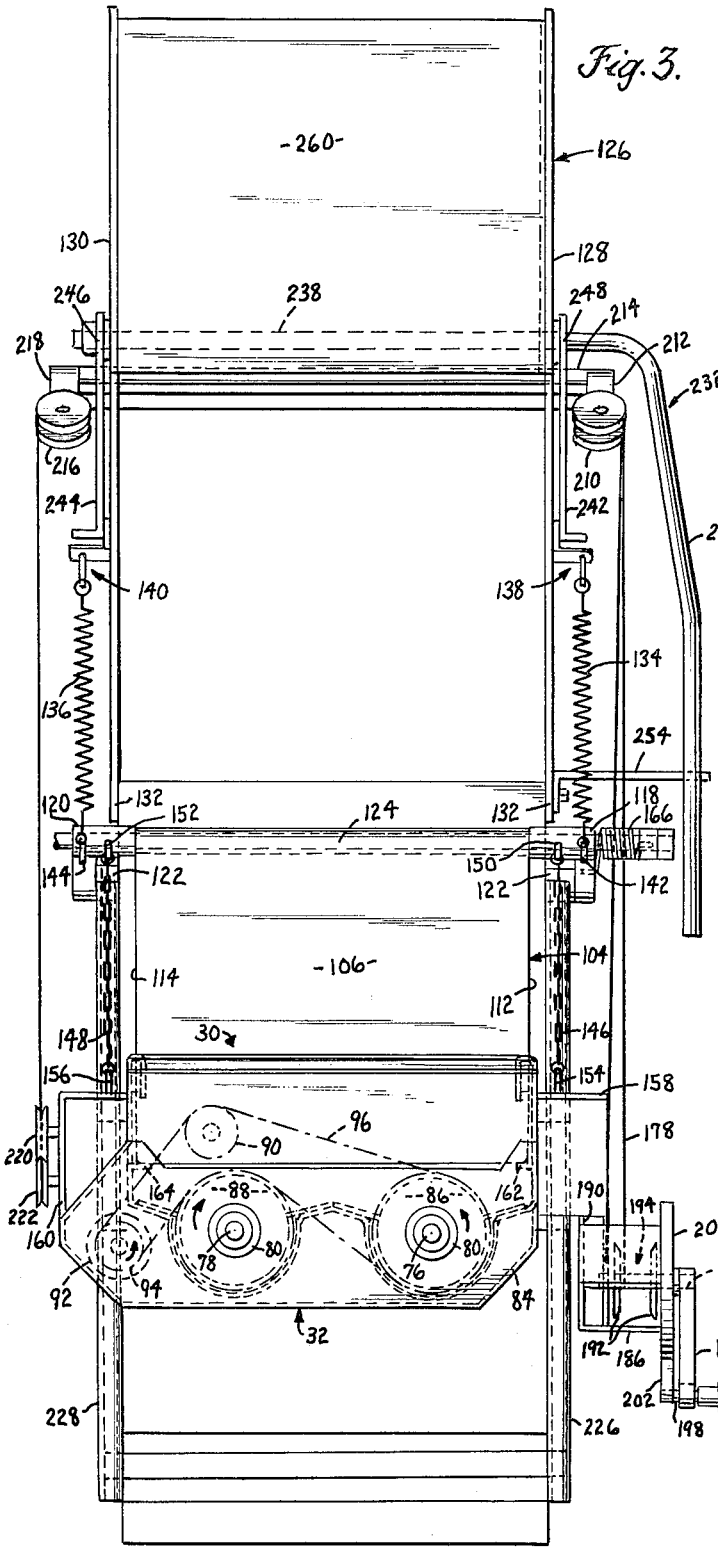
FIG. 3 is a front elevational view as seen in looking toward the right in FIG. 1 with the feeding apparatus being shown in the horizontal position of FIG. 2.
Figure 4:
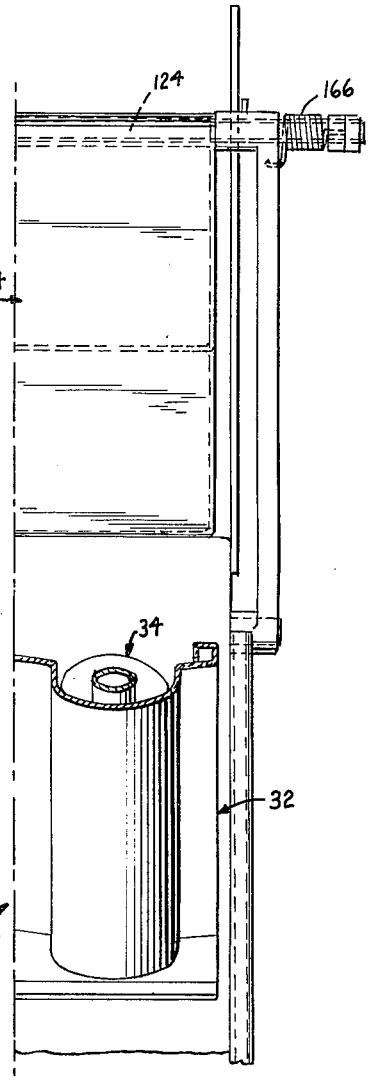
FIG. 4 is a fragmentary front elevational view taken along line 4—4 of FIG. 1, illustrating approximately the right one-half of the elongated feeding means and the closure means with support means therefor.

For driving the stub shafts 76,78 and, thereby, the auger shafts 68,70, the elongated feeding means 30 further includes drive means disposed within the drive housing 84, as seen in FIG. 3. The drive means includes driven sprockets 86,88 (see also FIG. 6) respectively fixedly mounted on the stub shafts 76,78 between and spaced from respective pairs of bearings 80, an idler sprocket 90 mounted within the drive housing 84 and spaced above left driven sprocket 88, a hydraulic motor 92 mounted within the drive housing 84 being spaced to the left of left driven sprocket 88 and having a driving sprocket 94, and a drive chain 96 which extends in an opposite manner partially about the driven sprockets 86,88 and partially about idler sprocket 90 and driving sprocket 94. When hydraulic motor 92 is rendered operative, its driving sprocket 94 rotates in a counterclockwise direction which, via chain 96, causes rotation of left driven sprocket 88 in a clockwise direction and rotation of right driven sprocket 86 in a counterclockwise direction, as indicated by the direction of the respective arrows in FIG. 3. Therefore, the left auger 36 is rotated clockwise and the right auger 34 is rotated counterclockwise, as indicated by the direction of the respective arrows in FIGS. 5 and 6. In view of such counterrotation of the augers 34,36 and of the above-described opposite spiralling of the respective flights 72,74 thereof, it is readily apparent that feed materials received in the trough 32 will be moved by the rotating augers 34,36 in a direction toward the hammermill housing opening 18.

It is preferable that the rate at which feed materials are conveyed by the augers 34,36 into the hammermill housing 16 to the material reducing rotor 20 be controlled by the speed of rotation of the rotor 20 at any given time. Thus, if the speed of the rotating rotor 20 has slowed somewhat due to high loading thereof, it is desirable that the speed of rotation of the material feeding augers 34,36 be gradually slowed or even that the rotation thereof be terminated in order to prevent possible over-loading of the rotor 20 and plugging thereof and resulting damage to drive components. Thus, a conventional mechanical/hydraulic speed governoring arrangement is preferably utilized to operate the hydraulic motor 92 at a speed which at all times is gradually increased or decreased (or terminated) as the rotational speed of the rotor 20 increases or decreases. It is not believed necessary to illustrate or describe such arrangement since such will be within the knowledge of one skilled in the art and is not required to understand the feeding apparatus 10.

Feed materials, such as ear corn and small grains, when deposited in the trough 32, will fill the empty spaces of pocket 38,40 38, along the respective auger flights 72,74 and thus will be conveyed along the pocket portions 38,40 upon rotation of the augers 34,36. However, in the case of other feed materials, such as baled roughages, it will be noted that the auger flights 72,74 extend substantially above the pocket portions 38,40 and the respective flanges 42,44 and 46,48 of the trough bottom so as to expose a sufficient amount of upper portions of the auger flights 72,74 to effectively engage and convey the baled roughages.

In order to prevent material of the baled roughages from wrapping around the auger shafts 68,70, longitudinally-extending stripper plates 98, as seen in FIGS. 5 and 6, are releasably secured to the respective flanges 42,44 and 46,48 by bolts 100 and extend to adjacent the auger flights 72,74 inwardly beyond the respective inside and outside, opposite top longitudinal edges of the pocket portions 38,40 74 as to close the gap between such edges and the auger flights 72,74. The stripper plates 98 also serve to confine the augers 34,36 in their desired positions in the pockets portions 38,40 of trough 32, as seen in FIG. 5. Thus, the stripper plates 98 must be removed in order to remove the augers 34,36 from the trough 32. Also, the holes in the stripper plates 98, by which means the bolts 100 attach the plates 98 to the trough flanges, are in the form of transversely-extending slots 102 which allow for adjustment of the plates 98 toward and away from the auger flights 72,74 whereby an optimum placement of the stripping plates 98 with respect to the flights 72,74 may be effectively achieved.

CLOSURE MEANS AND SUPPORT MEANS THEREFOR

As mentioned hereinbefore, the inner end 56 of the trough 32 of the elongated feeding means 30 is pivotally mounted between the sides of the hammermill housing 16 so as to extend through and transversely across a lower portion of the material receiving opening 18 defined in the housing 16. Therefore, an appreciable upper portion of the housing opening 18 above the inner end 56 of the trough 32 will remain open to the housing exterior, unless some provision is made to close it. If the opening 18 should be left open, there is nothing to prevent material within the housing 16, which is being acted upon by the rotating material reducing rotor 20, from being expelled at high rates of speed from the housing 16 through the opening 18. It is readily understood that such result is undesirable, as also is the expulsion of dust from the housing 16 through opening 18 which is generated due to the material reducing operation taking place therein.

It will be noted that such upper portion of the opening 18 could be closed without impeding the feeding of small grains by the augers 34,36 through the lower portion of the housing opening 18, since the inner end 56 of the trough 32 is open. However, in order to convey feed materials of a larger bulk or size, such as ear corn and, especially, baled roughages, into the housing 16, some or substantially all of the upper portion of the housing opening 18 above the inner end 56 of the trough 32 must be open to allow passage of such materials, since such materials are not totally confined below the upper limits of the trough side walls 50,52 as they are moved along the trough 32 toward the housing 16. For instance, it is readily apparent that the greater part of a bale of roughage will extend upwardly above the trough side walls 50,52.

Therefore, it would be advantageous to provide means which performs the dual functions of normally closing the upper portion of the housing opening 18 but allowing sufficient opening thereof upon the feeding of those materials which extend above the trough side walls 50,52. The apparatus comprising the present invention further includes closure means 104 which provides the aforementioned dual functions.

Referring again to FIGS. 1 through 3, the closure means 104 preferably takes the form of a body having a shape approximating one-half of a quadrant of a cylinder. The closure body 104 is formed by lower and upper walls 106,108 which are connected together at their forward edges and diverge therefrom rearwardly, a rear curved wall 110 being connected at its lower and upper edges respectively with the rear edges of the lower and upper walls 106,108, and a pair of spaced apart side walls 112,114 having a generally 45° triangular shape and being connected along the peripheries thereof respectively to side edges of the lower, upper and rear walls 106,108,110.

Support means is provided for disposing the closure body 104 adjacent the housing opening 18 and adjacent and above the inner portion of the elongated feeding means 30. The support means includes a pair of spaced apart support arms 118,120 being pivotally journalled at the rear ends thereof respectively to opposite sides of the hammermill housing at locations 122 which are spaced above locations 66 at which the trough 32 is pivotally mounted to the housing sides. Forward ends of the support arms 118,120 pivotally mount respective opposite ends of a transversely-extending pivot member 124. The lower and upper walls 106,108 of the closure body 104 are also connected with the pivot member 124 at their forward edges, whereby the closure body 104 is vertically pivotal with respect to the support arms 118,120 about a horizontal axis defined by the pivot member 124.

The support means also includes structure, generally designated 126, which is mounted on the top of the hammermill housing 16 and extends generally vertically therefrom. The structure 126 includes spaced apart vertical side plates 128,130 secured at 132 to the respective housing sides. For suspending the support arms 118,120 in a desired positional relationship with respect to the trough 32, a pair of springs 134,136 are connected at their inner ends to respective adjustment brackets 138,140 being respectively fixed to side plates 128,130 and at their outer ends to respective tabs 142,144 being respectively fixed to the forward ends of support arms 118,120 and a pair of chains 146,148 are anchored at their upper ends to respective tabs 150,152 being respectively fixed to the forward ends of support arms 118,120 and at their lower ends to respective eyes 154,156 of brackets 158,160 being respectively fixed to the trough side walls 50,52 along the outer portions 60 thereof. The springs 134,136 yieldably urge the support arms 118,120 toward the upright structure 126 and thereby hold the arms 118,120 displaced from the trough 32 through a distance equal to the full length of the chains 146,148 as adjustment means, to be described later hereinafter, disposes the trough 32 at a selected one of various feeding positions, as seen in FIG. 2. The chains are preferably of such a common length that the arms 118,120 extend generally parallel to the trough 32, as seen in FIG. 2, and that the displacement of the forward end of the closure body 104 mounted by the arms 118,120 from the augers 34,36 within the trough 32 will be sufficient to accommodate entry of a bale of roughage therebetween.

Therefore, in its normal position, the closure body 104 at the location of connection between the rear edge of its lower wall 106 and the lower edge of its rear curved wall 110 rests on inturned flanges 162,164 (FIG. 3) of trough side walls 50,52 along inner portions 64 thereof which supports such lowermost part of the closure body 104 just above the top periphery of auger flights 72,74, as clearly seen in FIGS. 2 and 3, aligns the lower wall 106 of the closure body 104 in a rearwardly and downwardly inclined fashion across the path of movement of feed materials, such as a bale of roughage, along the trough 32, and disposes the rear curved wall 110 of the closure body 104 across the hammermill housing opening 18 so as to substantially close the upper portion thereof above the inner end 56 of the trough 32.

Figure 10:
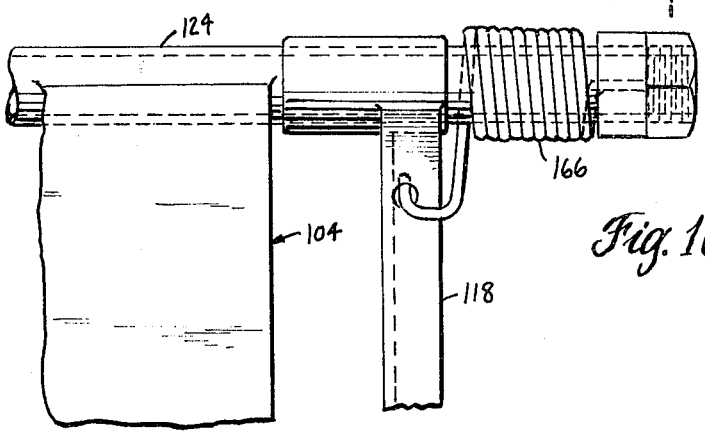
FIG. 10 is a fragmentary view on a larger scale than that of FIG. 4, illustrating spring means for the closure means of the apparatus.

The curvature of rear wall 110 of closure body 104 defines an arcuate path along which the rear curved wall 110 is moved when the closure body is pivoted upwardly away from the trough 32 due to engagement with the lower wall 106 of the closure body 104 and lifting thereof by a bale of roughage as the same is fed along the trough 32 toward the housing opening 18. The closure body 104, and thus its rear curved wall 110, will be displaced so as to open a sufficient portion of the housing opening for allowing passage of the bale into the housing 16 through the opening 18. A spring 166 is coiled about each opposite end of the pivot member 124 and connected thereto at one end and at the other end to a corresponding one of the support arms 118,120 (only the right spring 166 being shown in FIGS. 3 and 10) so as to support some of the weight of the closure body 104 and thereby assist in upward pivoting thereof by the bale.

Even though the housing opening 18 will be substantially open during such feeding of the bale, it will be apparent that the bale itself will substantially fill the upper portion of the opening 18 and thus substantially prevent the expulsion of ground material therethrough. Further, it will be readily understood that bales may be fed into the housing 16 in close succession. Once bale feeding is completed, the closure body 104 pivotally returns back to its normal portion in which its rear curved wall 110 closes the upper portion of the housing opening 18.

It will be noted that there is no opportunity for ground feed material to accumulate and stick on the closure body 104 so as to impede the effective pivoting thereof. Any material impacting against the rear curved wall 110 of the closure body 104, due to the reducing operation taking place within housing 16, which may have a tendency to stick to wall 110 will be scraped from the wall 110 by adjacent edge portions of the housing 16 each time the closure body 104 is pivoted upwardly by an infeeding bale. When hard feed materials, such as ear corn and small grains, are fed into the rotor 20, the presence of the rear wall 110 provides an effective structure for causing cracking of such materials upon their being impacted thereagainst due to the action of the rotor 20.

FEED ASSIST MEANS

The apparatus comprising the present invention also includes means for assisting the augers 34,36 in feeding bales of roughage through the housing opening 18 and into the material reducing rotor 20. Such feed assist means takes the form of a cylindrical feed roll 168 which is mounted on a shaft 170 being rotatably mounted to, and extending transversely between, the opposite sides of the hammermill housing 16. The rotational axis of shaft 170, and thus the roll 168 mounted thereto, is coincident with the pivotal axis of support arms 118,120.

Accordingly, the roll 168 is located in spaced relationship to, and directly above, the locations 66 at which the trough 32 is pivotally mounted to the housing sides. With the roll 168 being disposed at such location and with the diameter of the roll 168 being such that the outer periphery of the roll 168 is displaced from the inner ends of augers 34,36 through a distance somewhat less than the average height of a bale, the roll 168 will engage the upper portion of the bale upon the bale being moved through the housing opening 18 by the augers 34,36 at any of the various feeding positions of the trough 32, as seen in FIG. 2. The shaft 170 fixedly mounts a sprocket 172 which is drivingly coupled by a chain 174 to driving components of the machine driving means 26 for rotating the feed roll 168 in a counterclockwise direction, as illustrated by the arrow in FIG. 2.

ADJUSTMENT MEANS

As mentioned hereinbefore, the apparatus of the present invention further includes adjustment means for disposing the trough 32 at a selected one of various feeding positions, such as seen in FIG. 2. Also, because aforementioned springs 134,136 yieldably urge the support arms 118,120 toward the upright structure 126 and in view of the interconnection of the support arms 118,120 with the trough 32, adjustment of the trough 32 to a selected feeding position causes a corresponding concurrent adjustment in the position of the support arms 118,120 and the closure body 104 mounted thereto.

Referring to FIG. 3, the adjustment means includes a winch device 176, a system of pulleys to be described hereinafter, and a cable 178 threaded over the pulleys and being interconnected at one end to the trough 32 and at its opposite end to the winch device 176. The winch device 176 is operable and unwind the cable 178 to thereby pivotally raise and lower the trough 32.

Figure 9:
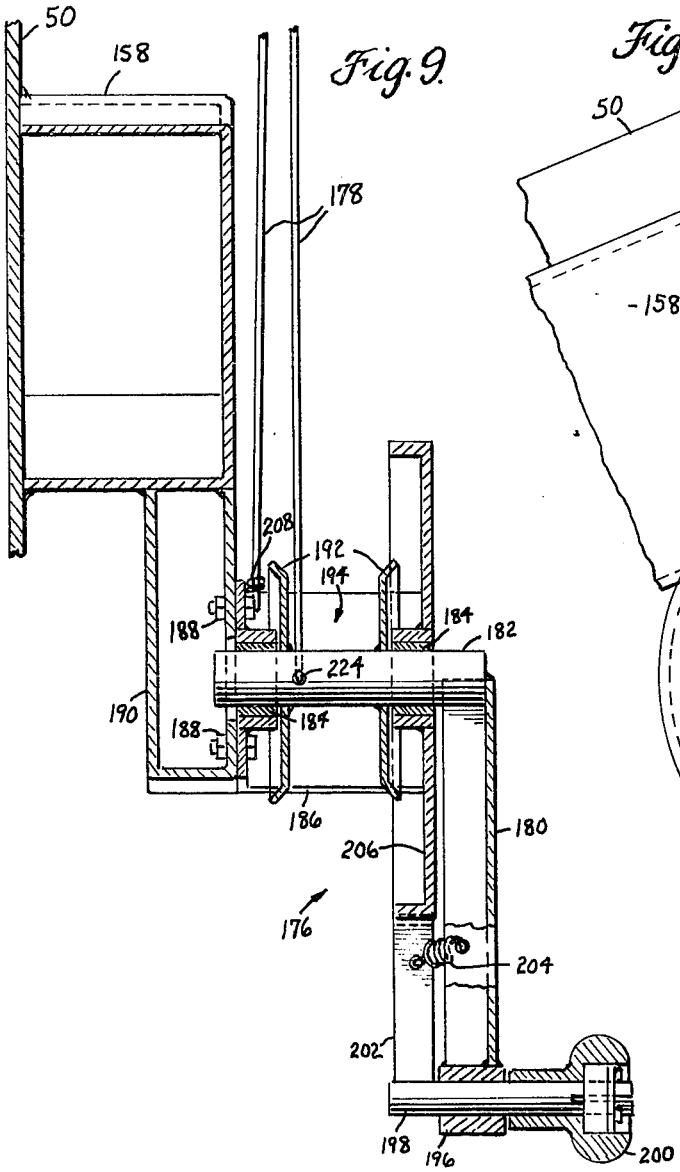
FIG. 9 is a front sectional view taken along line 9—9 of FIG. 8.
Figure 8:
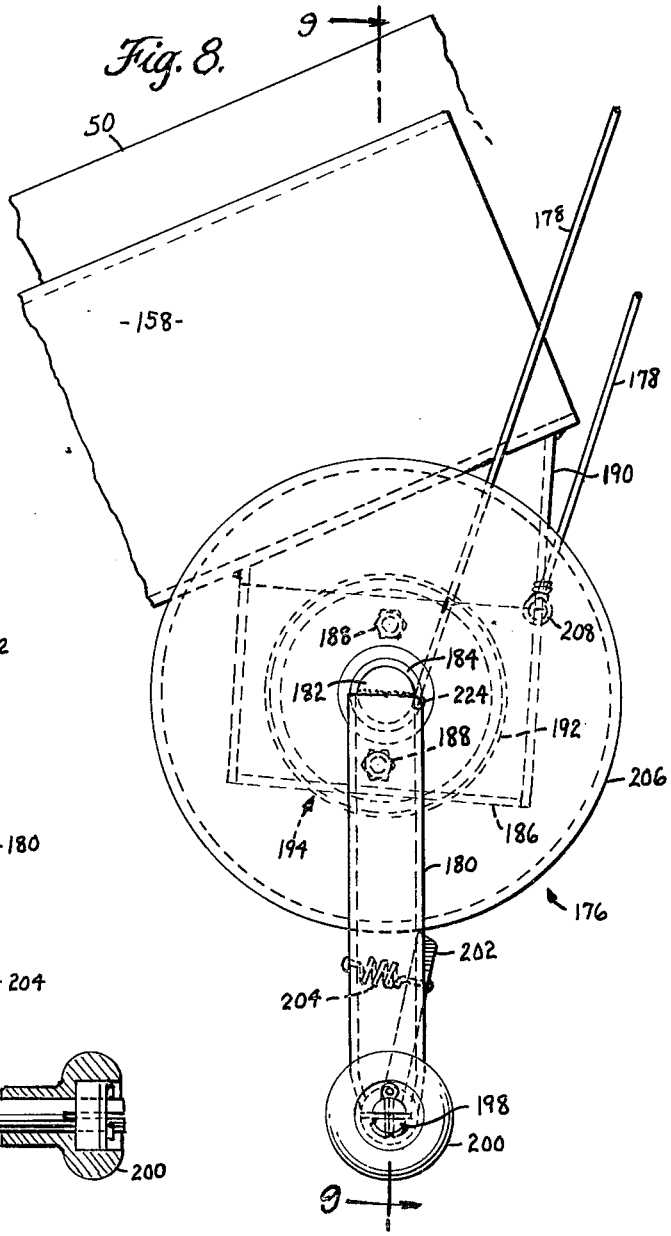
FIG. 8 is an enlarged side elevational view of a winch device for controlling raising and lowering of the elongated feeding means of the apparatus.

As seen in FIGS. 1 through 3 and in greater detail in FIGS. 8 and 9, the winch device 176 includes a crank arm 180 secured to a shaft 182 journalled in bearings 184 provided in a frame member 186 which is secured by means of bolts 188 to an extension member 190 of the right trough bracket 158. The shaft 182 and a pair of spaced discs 192 fixed thereto constitute a cable drum 194 of the winch device 176. The crank arm 180 is provided with a bushing 196 in which a spindle 198, having a crank knob 200 mounted at one end, is rotatably mounted. The opposite end of the spindle 198 mounts a pawl 202 which is urged by means of a spring 204 into biting contact with the periphery of a circular disc 206 fixedly attached to frame member 186.

As mentioned above, the cable 178 is threaded over the system of pulleys and interconnected at its one end to the trough 32 and at its opposite end to the winch device 176. The one end of cable 178 is anchored to the winch frame member 186 at 208. The cable 178 extends upwardly therefrom over a pulley 210, rotatably mounted to a straddle bracket 212 secured to one end of a tube 214 which extends transversely between and beyond side plates 128,30 of upright structure 126. Then, the cable 178 extends transversely across upright structure 126 and over a second pulley 216 rotatably mounted to a second straddle bracket 218 secured to an opposite end of the transverse tube 214. Therefrom, the cable 178 extends downwardly past a guide pulley 220, rotatably mounted to left trough bracket 160, and around an adjacent pulley 222, also rotatably mounted to left trough bracket 160. Therefrom, the cable 178 extends upwardly and over the second pulley 216, then transversely across upright structure 126 to and over pulley 210, and then finally downwardly to the winch device 176 to where its opposite end is anchored to cable drum 194 at 224.

OPERATING AND STORAGE POSITIONS

The above-described adjustment means is operable for disposing the trough 32, and also the support arms 118,120 and closure body 104 mounted thereto, at a selected one of various feeding positions, such as seen in FIG. 2. Also, it is operable for disposing the trough 32, support arms 118,120 and closure body 104 in a storage or transport position, as seen in FIG. 3.

Assuming that the trough 32 is to be raised from the inclined feeding position, shown in solid line form in FIG. 2 to the generally horizontal feeding position, being shown in broken line form in FIG. 2, the crank arm 180, and thereby the cable drum 194, of the winch device 176 is rotated in a clockwise direction to wind the cable 178 onto the drum 194 and thereby pivotally raise the trough 32. As seen in FIG. 2, as the trough 32 is so pivotally raised, which concurrently allows support arms 118,120 to pivotally raise and the forward portion of closure body 104 to elevate, the lowermost rear portion of the closure body 104 rides forwardly along the inturned flanges 162,164 of trough side walls 50,52 at the inner portions 64 thereof. However, because of the uniform height of the inner portions 64 of the trough side walls 50,52 the lowermost rear portion of the closure body 104 remains at its desired position just above the upper periphery of the auger flights 72,72. Also, the rear curved wall 110 of the closure body 104 still remains generally proximate the housing opening 18 so as to substantially close the upper portion thereof.

Referring to FIGS. 1 through 3, it will be noted that a pair of upright laterally spaced shield plates 226,228 are secured to and extend forwardly from the housing sides along and outwardly of respective trough side walls 50,52 and closure body side walls 112,114, and along and inwardly of support arms 118,120. A stabilizing cross member 230 is provided between the shield plates 226,228 adjacent the forward lower portions thereof. The shield plates 226,228 assist the lower portion of the rear curved wall 110 of the closure body 104 in closing the upper portion of the housing opening 18 when the trough 32, the support arms 118,120 and the closure body 104 are in the horizontal feeding position of FIG. 2. Also, the shield plates 226,228 assist in confining and guiding feed materials along the trough 32 as such materials are being fed to the housing opening 18 by the augers 34,36. It will be noted that the shield plates 226,228 extend forwardly to a location adjacent to the rear end of the outer portions 60 of trough side walls 50,52, which outer portions 60 are of increased height.

Once the trough 32 has been raised to its horizontal feeding position, or to any position located intermediately of the inclined and horizontal positions illustrated in FIG. 2, the crank arm 180 may be released and engagement of the spring loaded pawl 202 with circular disc 206 will maintain the crank arm 180, and thereby the cable drum 194, at such released position. Without the provision of the pawl 202 and circular disc 206, it should be noted that release of the crank arm 180 would cause counterclockwise spinning of arm 180 and drum 194, unwinding of the cable 178 from the drum 194 and abrupt lowering of the trough 32, due to the weight, which would likely result in damage thereto. However, upon release of the crank arm 180, the pawl 202 bites into the periphery of the fixed circular disc 206 to lock and prevent the crank arm 180 and the cable drum 194 for rotating counterclockwise and thereby prevent downward pivoting of the trough 32.

Assuming that the trough 32 is to be lowered back to its inclined feeding position, the bite of the pawl 202 on the periphery of the circular disc 206 can be released by a slight clockwise rotation of the knob 200 and spindle 198. The operator next holds the pawl 202 away from the periphery of disc 206 and the crank arm 180 and cable drum 194 are then allowed to rotate counterclockwise as the operator maintains control thereof. Once the desired lower position of the trough 32 is reached, the operator releases the pawl 202 and slight counterclockwise rotation of the crank knob 200 and spindle 198 will bring the pawl 202 back into biting contact with the periphery of disc 206.

In raising the trough 32 to the storage or transport position of FIG. 1, the crank arm 180 and cable drum 194 are again rotated in clockwise direction until a releasable latch device, generally designated by 232 and being rotatably mounted to respective side plates 128,130 of 52. structure 126, interengages respective forward lips 234,235 (FIGS. 1 and 5) on brackets 158,160 of trough side walls 50,52

In this upward movement of the trough 32, the support arms 118,120 pivot upwardly under the influence of springs 134,136 and chains 146,148 eventually slacken. The lowermost rear edge of the closure body 104 rides forwardly along inturned side wall flanges 162,164 then rearwardly and upwardly along the upper edges of the intermediate side wall portions 62 and then finally onto higher sidewall flanges 236,237 (FIGS. 1 and 5) of outer side wall portions 60. The latch device 232 includes a shaft 238 which is rotatably mounted to and extends transversely between and beyond respective side plates 128,130 of upright structure 126 and has a control lever 240 which depends downwardly from its right end. At the respective right and left ends of shaft 238, angular arms 242,244 are fixedly mounted and respectively have hook ends 246,248 which seat in front of bracket lips 234,235. To prevent inadvertent unlatching of the latch device 232, a lower free end portion of control lever 240 engages the tapered edge 252 (FIG. 7) of a bracket 254 secured to side plate 128 which tensions the lever 240 to cause it to snap into a hook shaped receiving notch 256 of the bracket 254.

To lower the trough 32 from the storage position, the pawl 202 is released from engagement with disc 206 in a manner hereinabove described and crank arm 180 is rotated in counterclockwise direction after control lever 240 has been released from notch 256 of bracket 254 and pivoted slightly clockwise to release hook ends 246,248 from engagement with lips 234,235 on bracket 158,160 of the trough side walls 50,52. Additional clockwise pivoting of control lever 240 will bring lower ends of angular arms 242,244 into engagement with support arms 118,120 and cause the disengagement of the trough 32 and the upright structure 126. Continued rotation of crank arm 180 in counterclockwise direction results in pivotal lowering of the trough 32, the support arms 118,120 and the closure body 104 until the bottom of the trough engages the stabilizing cross member 230 which acts as a stop limiting the downward movement of the trough 32.

As clearly shown in FIGS. 1 and 3, another shield plate 260 extends between and interconnects upper portions of side plates 128,130 of upright structure 126 above the storage position of pivot member 124 which interconnects support arms 118,120. When the trough 32, support arms 118,120 and closure member 104 are in the storage position, the closure member 104 is disposed above the housing 16 in the open area between the side plates 128,130 and below upper shield plate 260 of the upright structure 126. Thus, the closure body 104 at its lower wall 106 covers an intermediate portion of the top of the trough 32. Shield plate 260 seats against the remaining upper portion of the top of trough 32, whereby the shield plate 260 and the closure body 104 substantially close the portion of the open top of the trough 32 which extends above the housing 16 and thereby prevent rain and other undesirable elements from entering into the trough 32 and therefrom into the hammermill housing 16 when the trough 32 is in the upright storage position.

Also, engagement of a ledge 262 depending from inner end 56 of the trough 32 with plate 264 pivotally mounted to housing floor portion 266 seals the lower portion of housing opening 18 when the trough 32 is disposed in the storage position of FIG. 2.

It will be seen from the foregoing description that the apparatus of the present invention provides a very effective means for feeding whole bales of roughage, as well as other diverse feed materials, into a hammermill or the like with a minimum of manual effort, it only being necessary to place the bales into the trough 32. In the case of twine tied bales, it is unnecessary to remove the twine; in the case of wire tied bales, the wires can be readily removed after placing the bales in the trough. Also, the apparatus may be easily moved to a selected one of various possible feeding positions most convenient for the operator and also to a storage position during non-use or for transporting of the grinder-mixer machine.

It is thought that the invention and many of its attendant advantages will be understood from the foregoing description and it will be apparent that various changes may be made in the form, construction and arrangement of the parts of the machine described without departing from the spirit and scope of the invention or sacrificing all of its material advantages, the form hereinbefore described being merely a preferred embodiment thereof.

Having thus described the invention, what is claimed is:

1. Apparatus for feeding baled roughages, grains and other feed materials into a hammermill or the like which includes a housing having a material receiving opening defined therein, said apparatus comprising:

elongated feeding means for receiving feed materials at an upper side thereof and being mounted at one end portion to said housing adjacent a lower side of said opening therein and operable to convey feed materials into said housing through said opening;

closure means disposed adjacent said housing opening and adjacent and above said one end portion of said elongated feeding means, said closure means including a first surface portion which extends along a path near said housing opening to normally substantially close the same, said closure means being movably upwardly away from said elongated feeding means upon being engaged by feed material, such as baled roughage, as the latter is fed by said elongated feeding means toward said housing opening, said upward movement of said closure means causing its first surface portion to move upwardly along said path relative to said housing opening and thereby open a sufficient portion of said housing opening for allowing passage of said feed material into said housing through said portion of said housing opening; and operative feeding assist means mounted in said housing at a location spaced above said one end portion of said elongated feeding means and adjacent an upper portion of said housing opening, said feeding assist means for engaging upper portions of feed material, such as baled roughage, to thereby assist the feeding thereof through said housing by said elongated feeding means.

2. Apparatus as recited in claim 1, wherein said closure means is pivotally movable upwardly away from said elongated feeding means and said first surface portion of said closure means has a curved shape which defines said path along which said first surface portion moves relative to said housing opening upon pivoting of said closure means.

3. Apparatus as recited in claim 1, wherein said closure means further includes a second surface portion angularly displaced from said first surface portion and normally disposed adjacent said end portion of said elongated feeding means across a path along which feed material, such as baled roughages, are moved by said feeding means, said closure means being pivotally movable upwardly away from said elongated feeding means upon being engaged at its second surface portion by such feed material as the same is fed by said elongated feeding means toward said housing opening.

4. Apparatus as recited in claim 1, wherein:

said one end portion of said elongated feeding means is mounted to said housing across a lower portion of said opening therein; and said first surface portion of said closure means normally substantially closes said housing opening above said one end portion of said elongated feeding means.

5. Apparatus as recited in claim 4, wherein said elongated feeding means includes;

an elongated trough having an open top side and an open end in communication with said housing opening; and operable feed material conveying means mounted within said trough.

6. Apparatus as recited in claim 5, wherein said operable conveying means comprises a pair of augers extending longitudinally, and being rotatably mounted, within said trough.

7. Apparatus for feeding baled roughages, grains and other feed materials into a hammermill or the like which includes a housing having a material receiving opening defined therein, said apparatus comprising:

elongated feeding means for receiving feed materials at an upper side thereof and being pivotally mounted at one end portion to said housing adjacent a lower side of said opening therein and operable to convey feed materials into said housing through said opening;

closure means disposed adjacent said housing opening and adjacent and above said one end portion of said elongated feeding means, said closure means including a portion normally disposed to substantially close said housing opening, said closure means being movably upwardly away from said elongated feeding means upon being engaged by feed material, such as baled roughage, as the latter is fed by said elongated feeding means toward said housing opening, said upward movement of said closure means causing its portion to move upwardly relative to said housing opening and thereby open a sufficient portion of said housing opening for allowing passage of said feed material into said housing through said portion of said housing opening;

support means pivotally mounted at one end to said housing and extending outwardly therefrom to an opposite end spaced above said elongated feeding means, said closure means being mounted to said opposite end of said support means for pivotal movement upwardly in relation thereto and away from said elongated feeding means upon being engaged by feed material, such as baled roughage; and adjustment means for concurrently disposing said feeding means together with said support means and said closure means mounted thereto at various pivotally displaced feeding positions with respect to said housing.

8. Apparatus as recited in claim 7, wherein said adjustment means is also for concurrently disposing said feeding means together with said support means and said closure means mounted thereto at a generally upright storage position with respect to said housing.

9. Apparatus as recited in claim 8, wherein:

said adjustment means includes support structure mounted to an upper side of said housing and extending adjacent to said elongated feeding means when said feeding means is disposed at its storage portion; and a releasable latch device is provided being mounted to one of said feeding means and said support structure and operable for securing said feeding means to said support structure to thereby lock said feeding means in its storage position.

10. Apparatus as recited in claim 7, wherein said adjustment means comprises:

support structure mounted to an upper side of said housing;

a winch device operatively associated with one of said elongated feeding means and said support structure; and a flexible member interconnecting said elongated feeding means and said support structure and having a portion connected to said winch device.

11. Apparatus as recited in claim 10, wherein said winch device comprises:

a drum rotatably supported by one of said elongated feeding means and said support structure and being connected with said portion of said flexible member;

first means secured to said drum and operable for rotating said drum to respectively wind said flexible member about said drum or unwind said member therefrom; and second means operatively associated with at least one of said first means and said drum for maintaining said drum at any desired rotational position, after a desired amount of said flexible member has been wound thereabout or unwound therefrom, to thereby dispose said elongated feeding means at any one of its various pivotally displaced feeding positions with respect to said housing.

12. Apparatus as recited in claim 11, wherein:

said first means comprises a crank arm; and said second means comprises a circular disc fixedly supported by said one of said elongated feeding means and said support structure adjacent said arm and a spring loaded pawl carried by said arm and adapted for biting contact with the periphery of said disc to lock said arm and thereby said drum to which said arm is secured at said any desired rotational position.

13. Apparatus for feeding various feed materials into a hammermill or similar material reducing mechanisms which includes a housing having a material receiving opening defined therein, said apparatus comprising:

an elongated trough for receiving feed materials at an upper side and being pivotally mounted at one end portion to said housing adjacent said opening therein;

operative means mounted in said trough for conveying feed materials along said trough and into said housing through said opening therein;

support structure mounted to an upper side of said housing generally above said opening therein;

adjustment means interconnecting said trough and said support structure and operable to dispose said trough at a lower feeding position and at a generally upright storage position in which a portion of said trough extends above said housing and adjacent said support structure; and means operatively associated with said support structure and said trough for closing said upper side of said portion of said trough which extends above said housing when said trough is disposed at said storage position.

14. Apparatus as recited in claim 13, wherein said operatively associated means includes a portion which normally substantially closes said housing opening and is movable to open a sufficient portion of said housing opening for allowing passage of feed material, such as baled roughage, into said housing through said portion of said housing opening, when said trough is disposed at said lower feeding position.

15. Apparatus as recited in claim 13, wherein:

said trough is mounted to said housing adjacent a lower side said saod opening therein and said conveying means includes a pair of rotatably-mounted feeding augers disposed adjacent said housing opening lower side; and operative feeding assist means is mounted to said housing at a location spaced above said augers and adjacent an upper portion of said housing opening, said feeding assist means for engaging upper portions of feed material, such as baled roughages, to thereby assist the feeding thereof through said housing opening by said pair of augers of said feeding means.

16. Apparatus as recited in claim 15, wherein said feeding assist means comprises a rotatably driven feed roll.

* * * * *